United States Patent [19]

Michimae et al.

[11] Patent Number: 4,774,896

[45] Date of Patent: Oct. 4, 1988

[54] SLIDE DAMPERS FOR A VERTICAL TYPE OF APPARATUS FOR CONTINUOUSLY HEAT-TREATING SOLID WASTE

[75] Inventors: Kiyoharu Michimae; Akira Amamiya, both of Takaoka, Japan; Hiroshi Akimoto, Fort Lee, N.J.

[73] Assignees: The Brook Club, Toyama, Japan; Michimae Kyoharu

[21] Appl. No.: 81,588

[22] Filed: Aug. 3, 1987

Related U.S. Application Data

[63] Continuation of Ser. No. 885,947, Jul. 15, 1987, abandoned.

[30] Foreign Application Priority Data

Jul. 15, 1985 [JP] Japan ..... 60-154173

[51] Int. Cl.[4] ..... F23G 5/12

[52] U.S. Cl. ..... 110/256; 137/554; 137/242; 432/239

[58] Field of Search ..... 110/256, 235, 248, 346; 137/554, 242, 329.06; 251/1.3

[56] References Cited

U.S. PATENT DOCUMENTS

| | | | |
|---|---|---|---|
| 2,829,862 | 4/1958 | Wey | 137/242 |
| 3,350,056 | 10/1967 | Blumenkranz | 137/242 |
| 3,374,804 | 3/1968 | Stegerud | 137/242 |
| 3,415,504 | 12/1968 | Smith et al. | 432/239 |
| 3,801,082 | 4/1974 | Anderson | 110/256 |
| 3,859,619 | 1/1975 | Ishihara et al. | 137/554 |
| 4,452,154 | 6/1984 | Kono et al. | 110/256 |
| 4,468,559 | 8/1984 | Hurst et al. | 137/554 |
| 4,504,037 | 3/1985 | Beam et al. | 251/1.3 |
| 4,518,008 | 5/1985 | Fenster et al. | 137/554 |

*Primary Examiner*—Henry C. Yuen

*Attorney, Agent, or Firm*—Lee C. Robinson, Jr.

[57] ABSTRACT

The present invention relates to a slide damper system used for a vertical type of furnace for continuously heat-treating charged solid matters. This slide damper system comprises at least two slide damper means disposed vertically apart from each other in the furnace. The slide damper means is provided with means for preventing clogging with foreign matter and/or means for heat-resisting as well as means for preventing two or more slide damper means from opening simultaneously.

2 Claims, 3 Drawing Sheets

SLIDE DAMPERS FOR A VERTICAL TYPE OF APPARATUS FOR CONTINUOUSLY HEAT-TREATING SOLID WASTE

This application is a continuation of application Ser. No. 885,947, filed July 15, 1987 now abandoned.

BACKGROUND OF THE INVENTION

The present invention relates generally to a slide damper system used in a vertical type of furnace for continuously heat-treating the charge of solid matters such as lumps or powder and the like in a combustive gas atmosphere, and more particularly to a slide damper system used in a vertical type of furnace for continuously dry-distilling or heat-treating solid polymer wastes such as waste rubber tires, waste plastics and the like to recover the resulting combustive gases and/or liquids.

Combustible gases such as $H_2$, CO, $CH_4$, $C_2H_4$, $C_2H_6$, etc. are produced in this type of continuous and vertical furnace, such as a furnace for dry-distilling waste rubber tires. Therefore, in order to eliminate the danger of explosion due to binding such gases with oxygen in the air, and in addition to provide smooth control of the charge of waste rubber tires, it is required to shut off the interior of the furnace from the open air, to raise the interior pressure a little higher than atmospheric pressure, and to provide the minimum of non-filled interior space within the furnace.

DESCRIPTION OF THE PRIOR ART

For example, Japanese Patent Application Nos. 169396/79 and 169397/79, and Japanese Laid-Open Patent Application Publication No. 45779/83 disclose a typical, conventional slide damper system used in a vertical type of furnace for continuously dry-distilling the charge of waste rubber tires. FIG. 1 schematically shows such a slide damper system disclosed in these references.

FIG. 1 is a vertical, sectional, partially schematic view of the slide damper system used in a furnace for continuously dry-distilling waste rubber tires. This furnace comprises a furnace body 1, an inlet 2 disposed on the top of the furnace for charging waste rubber tires into its interior, an upper hopper 3, a gas leakage-sealing damper means 4 for sealing the interior of the furnace from the open air, the first slide damper means 5 disposed below and apart from the gas leakage-sealing damper means 4 and forming a primary replacement chamber 9 below the leakage-sealing damper means 4, the second slide damper means 6 disposed below and spaced apart from the first slide damper means 5 and forming a secondary replacement chamber 10 below the first slide damper means 5, a dry-distillation chamber 7 formed below the second slide damper means 6, and a gas outlet 8 for discharging a flow of dry-distilled gases.

As shown in FIG. 1, each of the conventional slide damper means such as the first and second slide damper means 5 and 6 consists of a pair of symmetrical plates **5*a* or 6*a*** respectively.

As shown in FIG. 1, each of these conventional slide damper means 5 and 6 has a structure by which the symmetrical plates **5*a* or 6*a*** can be driven or moved in their respective opening and shutting actions in a horizontal direction by a suitable driving means (not shown). These slide damper means repeat a large number of their opening and shutting motions during operation of the furnace, so that the sliding faces of the plates are apt to be clogged with foreign matter such as small pieces of residue of charged solids and the like, thereby permitting the opening and shutting motions to become impossible, and it is often feared that such an accident will happen, causing a suspension of the furnace run.

Futhermore, the damper means adjacent to the dry-distillation chamber 7 such as the second slide damper means 6 is exposed to a high temperature, for example, temperatures higher than 600° C., and the two plates **6*a* collide a relatively great impact with each other at this high temperature when they are closed. Therefore, the probability that a failure of the damper plates 6*a*** will occur is relatively high.

Furthermore, the control of timing of the opening and shutting operations between the first and second slide damper means 5 and 6 is not sufficient from the standpoint of prevention of a combustible gas explosion.

It is therefore an object of the present invention to provide a slide damper system having means for preventing of the slide dampers with foreign matter such as residues of the charged solid matters, where the slide dampers are to be used in a vertical type of furnace for continuously heat-treating the charge of solid matters to produce a flow of combustible gases, and are used in order to securely seal the interior of the furnace from the open air and to permit a smooth and long-term continuous run of the furnace.

It is another object of the present invention to provide a slide damper system having means for preventing clogging with foreign matter as well as a means for heat-resisting to be used in a vertical type of furnace for continuously heat-treating the charge of solid matters to produce a flow of combustible gases, in order to securely seal the interior of the furnace from the open air and to improve the heat-resistance of the slide damper means, as well as to provide a smooth, long-term continuous run of the furnace.

Furthermore, it is another object of the present invention to provide a slide damper system used in a vertical type of furnace for continuously heat-treating the charge of solid matters to produce a flow of combustible gases, said system comprising at least two slide damper means disposed vertically spaced apart from each other in the furnace, and having means for preventing clogging of the slide dampers with foreign matter, means for heat-resisting for preventing combustion of the solid matters in the replacement chambers, and means for detecting and controlling the opening and shutting actions of the slide damper means as well as for assuring that the two or more slide damper means do not open simultaneously.

SUMMARY OF THE INVENTION

The slide damper system of the present invention used in a vertical type of furnace for continuously heat-treating the charge of solid matters comprises at least two slide damper means disposed vertically apart from each other in the furnace. Each slide damper means is provided with means for preventing clogging with small pieces of residue of the charged solid matters, and/or means for heat-resisting. The slide damper system has means for sensing and controlling the opening and shutting actions of the slide damper means, and means for preventing two or more slide damper means from opening simultaneously.

The slide damper means provided with means for prevention of clogging with the charged solid residue comprises two bisected, V-shaped slide plates each having a predetermined angle of inclination ($\theta$) to a horizontal axis, or two unequally divided, horizontal type slide plates consisting of a main plate capable of closing the cross-sectional area of the furnace body by itself and a minor plate. The slide damper means provided with the heat-resisting means comprises also two unequally divided, horizontal type slide plates consisting of a main plate capable of closing the cross-sectional area of the furnace body by itself and a minor plate.

The clogging of the charged solid residue into a gap between sliding portions of the damper means can be prevented by use of this bisected V-shaped slide damper means according to the present invention, and thus a smooth charging of solid matters into the lower chamber can be obtained.

In addition to said prevention of clogging with residue, the heat-resistance of the slide damper means can be improved by use of the unequally divided, horizontal slide damper means.

The smooth control of the charge of solid matters and the prevention of combustible as explosion are obtained by disposing at least two unequally divided horizontal and/or bisected V-shaped slide damper means vertically spaced apart from each other in the body of the furnace, and providing means for sensing and controlling the opening and shutting actions of said damper means and means for preventing said two or more damper means from opening simultaneously.

DETAILED DESCRIPTION OF THE PREFERRED EMBODIMENTS OF THE INVENTION

Figure 1:
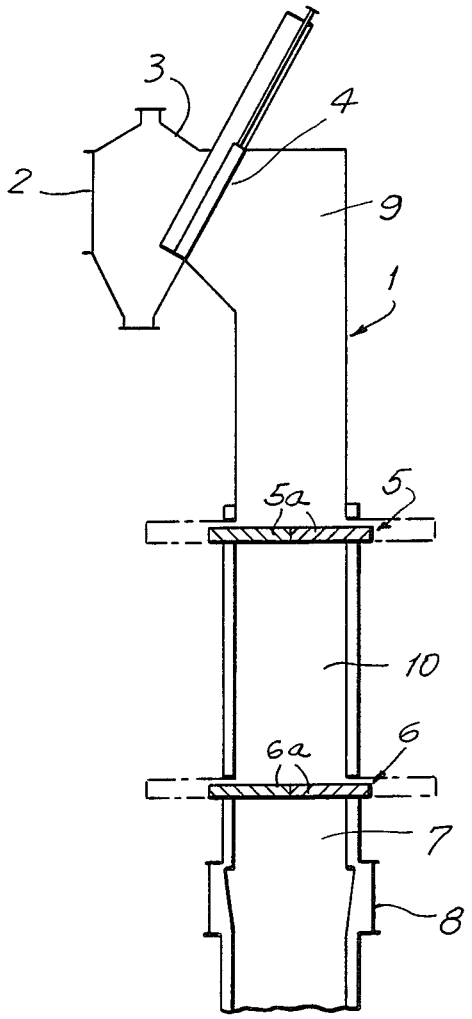
FIG. 1 is a schematic longitudinal sectional view of a conventional slide damper system used in a furnace for heat-treating waste rubber tires.
Figure 2A:
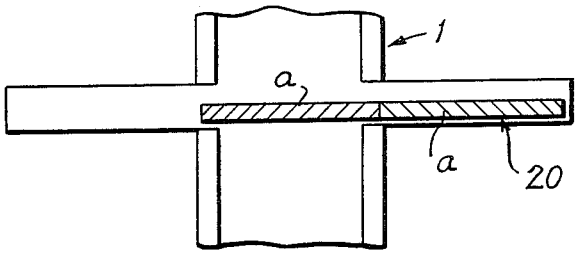
FIGS. 2(A), 2(B) and 2(C) are sectional partially schematic views of several types of slide dampers according to the present invention.
Figure 2B:
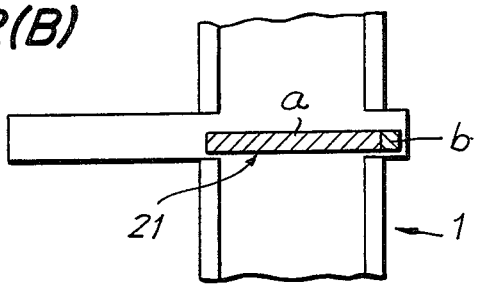
Figure 2C:
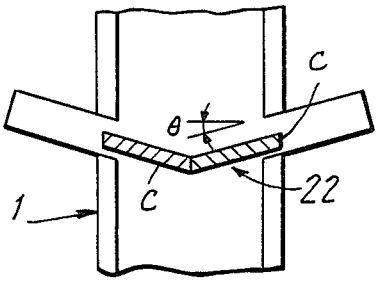

FIGS. 2(A)–2(C) show sectional partially schematic views of a slide damper according to the present invention. The slide damper 20 shown in FIG. 2(A) is a horizontally disposed, bisected slide damper consisting of two plates 20*a* of equal size. This slide damper can close or cover the cross-sectional area of the body of an apparatus or furnace for heat-treating the charged solid matters by a one-sided plate. Either of two plates 20*a* is moved alternatively or every several times to close the cross-sectional area of the body 1. This slide damper 20 is excellent in durability and heat-resistance but it is inferior to others in cost.

The slide damper 21 shown in FIG. 2(B) is an unequally divided, horizontal type of slide damper, consisting of a main plate 21*a* capable of closing the cross-sectional area of the body 1 by itself and a minor plate 21*b*. When the main plate 21*a* is opened, the minor plate 21*b* is positively moved right and left several times to remove the charged solid residue being in danger of blocking up the sliding portions of the plate. Furthermore, this type of slide damper 21 can be disposed at a relatively high temperature place such as a dry-distillation chamber because the heat-resistant main location 21*a* can close the cross-sectional area of the body 1 alone.

The slide damper 22 shown in FIG. 2(C) is a bisected, V-shaped slide damper which consists of two equal-sized plates 22*c* disposed at a predetermined angle to a horizontal axis, for example, $\theta=5°$ to 60°. This type of slide damper 22 eliminates the danger of blocking up the gap between its sliding portions with charged solid residues because the residues can easily fall down upon the opening action of the plates 22*c*. Furthermore, this V-shaped slide damper 22 can smoothly drop the charge of solid matter into the center in the lower portion of the furnace. On the other hand, the unequally divided, horizontal type of slide damper 21 tends to throw the charge of solid matters down to one side of the body 1.

Figure 3A:
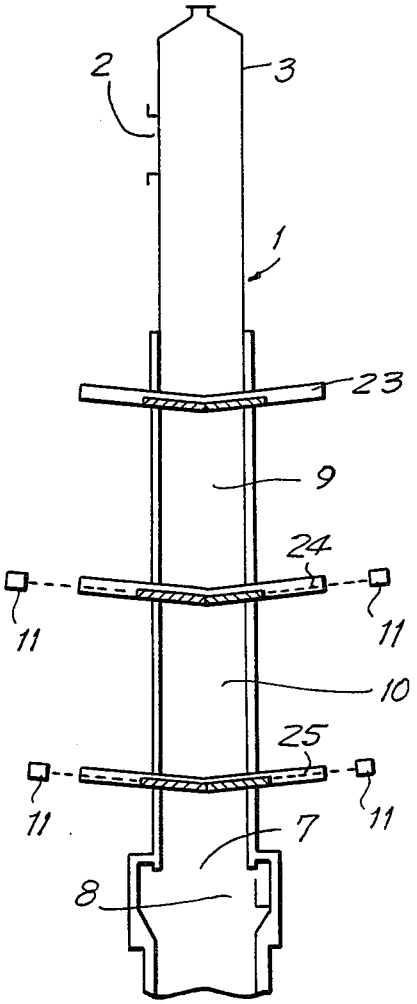
FIGS. 3(A) and 3(B) show schematic longitudinal sectional views of a preferred embodiment of the slide damper system used in a vertical type of furnace for continuously heat-treating waste rubber tires.
Figure 3B:
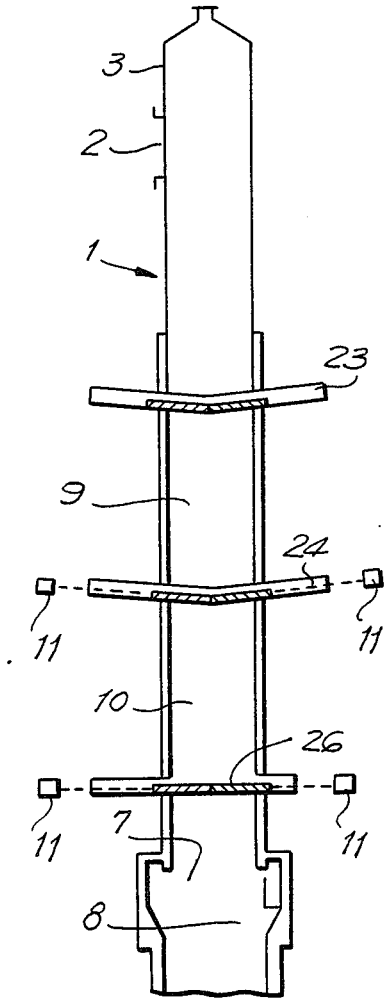

Referring now to FIGS. 3(A) and 3(B), the slide damper systems according to the present invention are mounted in a furnace for dry-distilling waste rubber tires. The furnace shown in FIG. 3(A) comprises a body 1 of the furnace, an inlet 2 for charging waste rubber tires into the body 1 at its top, an upper hopper 3, a gas sealing, bisected, V-shaped slide damper 23 disposed in the upper portion of the body 1 for shutting off the interior of the body 1 from the open air, the first bisected, V-shaped slide damper 24 disposed below and spaced from the gas sealing slide damper 23 for forming a primary replacement chamber 9 of the tires, the second bisected, V-shaped slide damper 25 disposed below and spaced from the first slide damper 24 for forming a secondary replacement chamber 10, detectors 11 attached to the first slide damper 24 and the second slide damper 25 for detecting their opening and/or shutting states, a dry-distillation chamber 7 defined below the second slide damper 25 and a gas outlet 8 disposed in the upper portion of the dry-distillation chamber 7.

The furnace for dry-distilling waste rubber tires provided with the slide damper system of the present invention shown in FIG. 2(B) is similar to that shown in FIG. 2(A), except that the former furnace utilizes an unequally divided, horizontal type of slide damper 26 such as that 21 shown in FIG. 2(B), instead of the bisected, V-shaped slide damper 25.

Referring to FIG. 3, the operation of the slide damper system of the present invention provided in the furnace for dry-distilling waste rubber tires will be described below.

By opening the gas sealing slide damper 23, the waste rubber tires charged thereon are dropped into the primary replacement chamber 9 defined on the closed first slide damper 24. When a predetermined amount of the tires is charged into the primary replacement chamber 9, the gas-sealing damper 23 is closed. In this situation, the first slide damper 24 is opened to allow the entire charge of tires within the primary replacement chamber 9 to drop into the secondary replacement chamber 10 and then the first slide damper 24 is closed. Then, when dry distillation reaction of the waste rubber tires previously charged into the dry distillation chamber 7 proceeds and thus the volume of the tires charged into the chamber 7 decreases to less than a predetermined level, the second slide damper 25 or 26 is opened to drop the entire charge of tires in the secondary replacement chamber 10 into the dry-distillation chamber 7.

However, there is a possibility that the tires in the second replacement chamber 10 may not entirely fall into the distillation chamber 7 and thus a portion of the tires may be sandwiched between two plates of the second slide damper 25 or 26, or small piece residues of the charged tires may be lodged between the sliding portions of the plates. In such a case, this situation of the slide damper can be detected with the detectors 11, to permit the second slide damper 25 or 26 to effect repeated opening and closing motions at a cycle of relatively short time until the second slide damper 25 or 26 can be fully closed, under the fully closed condition of the first slide damper 24. In this manner, in order to prevent explosion of combustible gases produced in the furnace, the slide damper system of the present invention has a safety means for controlling the opening and shutting actions of all of the slide dampers by the signals detected with the detectors 11 to prevent the first and second slide dampers from opening simultaneously.

The slide damper system of the present invention applied to the vertical furnace for continuously dry distilling waste rubber tires has been described. This slide damper system can be utilized with various other apparatus such as an apparatus for oxidizing, reducing, decomposing, or refining powder, mass, or their mixture, and the like.

What is claimed is:

1. A slide damper system used for a vertical type of furnace for continuously heat-treating non-particulate matter to recover the resulting combustive gases and/or liquids, comprising a gas sealing slide damper disposed in the upper portion of the furnace for sealing the interior of the furnace from the open air; at least two V-shaped slide damper means having a predetermined angle of inclination to a horizontal axis and movable at the same predetermined angle of inclination and vertically disposed below said gas sealing slide damper and spaced from each other in the furnace; each said slide damper means having a pair of plates abuttable at one end thereof to provide a retention means for the non-particulate matter, one plate of which is inclined generally downwardly and another plate of which is inclined generally upwardly, said plates define the V-shaped dampers and aid in charging the non-particulate matter into a dry-distillation chamber; and means for sensing and controlling the opening and closing actions of such slide damper means at the same predetermined angle of inclination for preventing two or more said slide damper means from opening simultaneously and for preventing the slide damper means from becoming clogged with residue of the charged non-particulate matter; and said slide damper means including means for heat-resisting.

2. The slide damper system as set forth in claim 1 wherein said heat resisting means include two unequally divided, horizontal plates wherein one of the plates is capable of closing the cross-sectional area of the body.

* * * * *